United States Patent [19]

Abendroth et al.

[11] 4,311,093

[45] Jan. 19, 1982

[54] SHEET FEEDING ASSEMBLY INCLUDING PROVISION FOR COORDINATED ACTION OF PRE-GRIPPER AND FRONT STOP

[75] Inventors: Paul Abendroth; Helmust Emrich, both of Offenbach am Main, Fed. Rep. of Germany

[73] Assignee: M.A.N.-Roland Druckmaschinen Aktiengesellschaft, Fed. Rep. of Germany

[21] Appl. No.: 64,082

[22] Filed: Aug. 6, 1979

[51] Int. Cl.[3] ..... B41F 21/06

[52] U.S. Cl. ..... 101/232; 101/409; 101/242; 271/247; 271/256

[58] Field of Search ..... 101/232, 409, 242; 271/226, 245, 246, 247, 256

[56] References Cited

U.S. PATENT DOCUMENTS

| | | | |
|---|---|---|---|
| 1,984,588 | 12/1934 | Liebusch | 271/247 |
| 3,788,639 | 1/1974 | Bou | 101/409 X |
| 3,822,644 | 7/1974 | Gazzola et al. | 101/242 |
| 3,921,523 | 11/1975 | Jähme | 101/232 |
| 3,992,993 | 11/1976 | Kuhn et al. | 101/409 |
| 4,085,673 | 4/1978 | Wierszewski | 271/247 X |

FOREIGN PATENT DOCUMENTS

| | | | |
|---|---|---|---|
| 1212114 | 3/1966 | Fed. Rep. of Germany | 101/232 |
| 1786314 | 11/1971 | Fed. Rep. of Germany | 101/232 |
| 448490 | 6/1936 | United Kingdom | 271/247 |
| 520271 | 9/1976 | U.S.S.R. | 101/242 |

*Primary Examiner*—Edward M. Coven
*Attorney, Agent, or Firm*—Leydig, Volt, Osann, Mayer & Holt, Ltd.

[57] ABSTRACT

A feed assembly for feeding sheets seriatim from a position of register on a feed table to an impression cylinder in a printing press which includes a pre-gripper having an oscillating connection with the press drive for periodically swinging the pre-gripper from a sheet pick-up position at the front edge of the table to a sheet-releasing position at the surface of the impression cylinder. The pre-gripper has a jaw and a jaw lever for opening and closing the jaw. A gripper operating cam is arranged in the path of movement of the jaw lever as the pre-gripper oscillates back and forth, the oeprating cam being mounted for retreating and return movement to control the opening and closing movement of the jaw. A rotating control cam coupled to the press drive has a control cam follower with a linkage for connecting the same to the gripper operating cam for controlling its retreating and return movement so that the jaw is closed upon an awaiting sheet at the pick-up position. The same linkage is also coupled to the front stop via an adjustable lost motion connection for moving the front stop to a retracted position only after a predetermined movement of the gripper operating cam and timed with closure of the jaw. A pawl interposed in the path of movement of the control cam follower silences both the jaw and the front stop to terminate the feeding of sheets.

4 Claims, 2 Drawing Figures

SHEET FEEDING ASSEMBLY INCLUDING PROVISION FOR COORDINATED ACTION OF PRE-GRIPPER AND FRONT STOP

It is conventional in a sheet-fed printing press to provide a pre-gripper for transferring sheets from a feed table to the grippers on an impression cylinder, with means being provided for retracting the stops at the front edge of the table as necessary to free the sheet. Such an arrangement is shown in German Auslegeschrift 1,212,114, but the mechanism shown therein is expensive to construct and maintain and not fully reliable because the gripper operating mechanism and the front stops have drives which are independent from one another. It is also known from Auslegeschrift No. 1,786,314 that the movement of a front stop can be blocked by a locking lever combination; however, no means are provided for preventing seizure by the pre-gripper when the front stop is in locked condition.

It is an object of the present invention to provide a sheet feeding assembly for feeding sheets from a feed table to an impression cylinder which is highly precise, which preserves accuracy of register from the table to the impression cylinder and in which such accuracy is constant all of the way to the highest speeds employed in modern day presses. It is, more specifically, an object of the present invention to provide a single control cam, cam follower and linkage for operating both the jaw of the pre-gripper and the front stop so that synchronism between the two, once set, is accurately maintained over long periods of time.

It is another object of the invention to provide a sheet feeding assembly in which precise timing of the retraction of the front stop is achieved relative to the closing of the jaw in the pre-gripper by quick and easy adjustment of a lost motion connection.

It is yet another object of the present invention to provide, in a device of the above type, including a control cam follower for operating both the jaw of the pregripper and retraction of the front stop, a pawl effectively interposed in the path of movement of the follower, thereby to prevent both closure of the jaw and retraction of the front stop to insure against transfer of a sheet, or damage to the sheet, when the mechanism is in silenced condition.

It is a general object to provide a sheet feeding assembly which is of simple and durable construction, economical to manufacture and maintain, and which is inherently compact, with low inertial forces, enabling use in sheet-fed presses over a wide size range including the smallest commercial presses.

Other objects and advantages of the invention will become apparent upon reading the attached detailed description and upon reference to the drawing in which.

Figure 1:
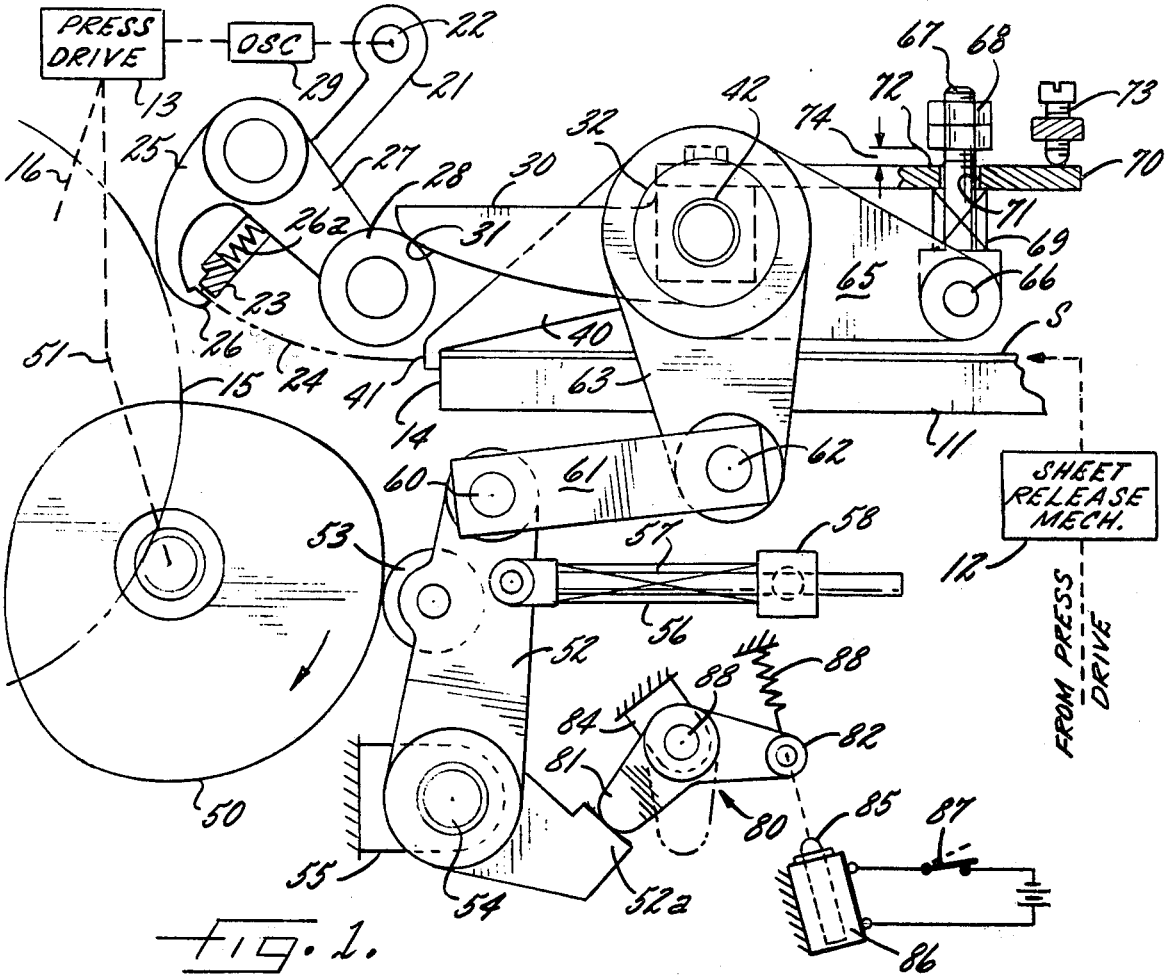
FIG. 1 is a fragmentary side elevational view, in diagrammatic form, of a sheet feeding assembly constructed in accordance with the present invention.
Figure 2:
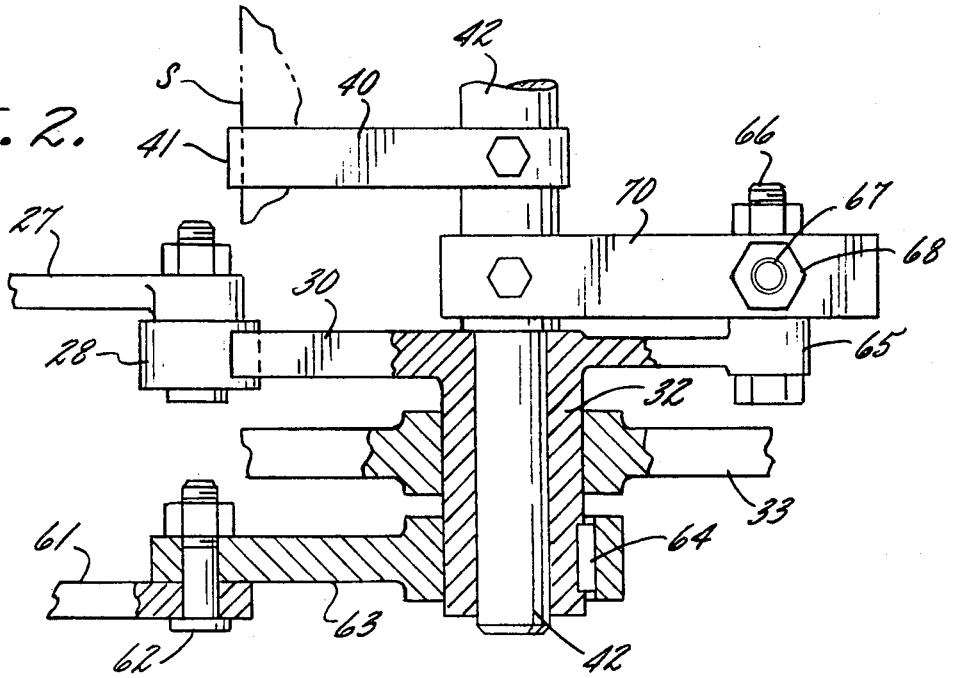
FIG. 2 is a fragmentary top view of the mechanism shown in FIG. 1.

While the invention has been described in connection with a preferred embodiment, it will be understood that we do not intend to be limited to the particular embodiment shown but intend, on the contrary, to cover the various alternative and equivalent constructions included within the spirit and scope of the appended claims.

Turning now to the drawings, there is disclosed a feeding assembly 10 for feeding a sheet S from a feed table 11, the sheet having been deposited on the table by a sheet release mechanism 12 coupled to the press drive 13. The front edge 14 of the table is presented to, and spaced from, an impression cylinder 15 having a drive connection 16 to the press drive.

Interposed between the table and the cylinder 15 is a pre-gripper 20, set forth in diagrammatic form, having a frame 21 and which is swingable about an axis 22. The frame carries a fixed jaw 23 which follows an arcuate path 24 between a pick-up position at the front edge of the table and a releasing position at the surface of the impression cylinder. Pivoted on the pre-gripper frame is a gripper 25 having at its end a movable jaw 26 and which is coupled to a jaw lever 27 in the form of a cam follower having a roller 28 at the end thereof. The jaw 26 is biased into closed position by a spring **26*a*. The frame of the pregripper is connected to the press drive for periodic swinging movement by means of an oscillating connection 29**.

Arranged in the path of movement of the roller 28 for the purpose of operating the jaw timed with the swinging movement is a gripper operating cam 30 having a cam face 31. The cam 30 is mounted on a sleeve 32 supported in the press side frame 33 for retreating and return movement relative to the jaw lever. By retreating movement is meant motion away from the jaw lever while return movement is movement in the opposite direction.

For the purpose of intercepting, and registering, the front edge of the sheet S fed onto the feed table, a front stop 40 is provided having a lip 41 and which is mounted for upward and downward rocking movement on a shaft 42, which penetrates the sleeve 32, between the illustrated "intercepting" position and an "upwardly retracted" position in which the sheet is freed for transfer from the table.

In accordance with the present invention a rotary control cam is provided which is coupled to the press drive and which has a control cam follower. A linkage connects the control cam follower to the gripper operating cam for controlling the retreating and return movement of the latter so that the jaw is open during travel and closed to engage the edge of the sheet when it reaches the pick-up position. A lost motion connection is provided for coupling the same linkage to the front stop positioning means so that the front stop is moved to a retracted position timed with closure of the jaw upon the sheet.

Thus referring to the drawing, the control cam indicated at 50 has a drive connection 51 to the press drive. At the periphery of the cam is a cam follower lever 52 having an anti-friction roller 53 and which is mounted for rocking movement on a pivot 54 fixedly journaled in a pedestal 55. For normally urging the cam follower lever 52 in the direction of the cam 50, a compression spring 56 is provided which is telescoped over a plunger 57 and which reacts against a fixed guide block 58.

Connected to a pivot 60 at the upper end of the follower lever 52 is a generally horizontal link 61 which is in turn pinned at 62 to the lower end of an arm 63. The latter is secured, at its upper end, by a key 64 to the sleeve 32.

The same linkage which had just been described is, in accordance with the invention, utilized to operate the front stop 40 via a phasing connection here in the form of a lost motion connection. To provide the lost motion there is integrally connected to the gripper operating cam 30 an arm 65 carrying a transverse pin 66, in the form of a bolt, at its outer end. The pin 66 engages the lower end of a plunger 67 having a stop nut 68 and which has, telescoped about it, a compression spring 69.

For operating the front stop 40 a front stop arm 70 is provided on the shaft 42 having a clearance opening 71 through which the plunger 67 projects and which is surrounded by a land 72 for engagement by the stop nut. The spring 69, pressing against the underside of the arm 70, tends to rock the front stop 40 counterclockwise, with the degree of engagement of the lip 41 thereon being determined by fixed but adjustable stop 73.

In operation the stop nut 68 is so adjusted that a clearance gap 74 exists under the nut when the cam follower lever 52 occupies a "high" position on the cam 50 and when the arm 70 is in seated position upon the stop 73. This provides lost motion so that the gripper operating cam can undergo initial rotational movement in the clockwise direction when engaged by the jaw lever 27 without producing retraction at the front stop, thereby delaying release of the sheet until the sheet has been gripped by the jaw 26.

Before describing a typical feed cycle, reference may be made to the means for interrupting or silencing, the feed, the mechanism being shown, in FIG. 1, in the silenced condition. This is accomplished by a pawl which is effectively interposed in the path of following movement of the control cam follower, the pawl being connected to an electromagnet for moving the same into its interposed position. As shown in the drawing, the pawl is in the form of a dog-leg lever 80 having a pawl arm 81 and an operating arm 82, the lever being centrally pinned upon a pin 83 journaled in a fixed pedestal 84. The operating arm has a mechanical connection to the plunger 85 of a solenoid 86 energizable by a switch 87. The pawl lever is urged in the counterclockwise direction by a tension type return spring 88. When the solenoid is energized, the pawl arm 81 rotates from the dot-dash position to the full position which is on dead center and in obstructing relation to a projection 52*a* on the control cam follower 52. The pawl is thus effectively interposed in the path of following movement of the cam follower, defeating expansion of the spring 56 and preventing the follower from following the "low" of a cam, thereby preventing transmission of clockwise rocking movement to the gripper operating cam 30 or front stop 40. Because of the dead center relationship only a small solenoid, using a negligible amount of current, suffices to move the pawl lever to its obstructing position.

In the discussion which follows it will be assumed that the switch 87 is open so that the solenoid is de-energized and so that the pawl 81 occupies its non-obstructing, dot-dash, position. Thus during normal feeding operation, with the pre-gripper being oscillated back and forth by its drive mechanism 29, and with the control cam 50 being constantly rotated by the press drive, the control cam follower 52 is phased to drop into a "low" on the cam 50 as the jaw on the pre-gripper approaches the edge of the table. This results in leftward movement of the link 61 and clockwise rocking movement of gripper operating cam 30. The initial portion of the clockwise movement occurs idly as far as the front stop 40 is concerned, as the lost motion at 74 is taken up, so that the front stop is, at first, unaffected. However, a point in the clockwise movement will be reached where the nut 68 engages the arm 70, causing the front stop 40 to begin to lift. As the pre-gripper reaches the limit of its swinging movement, the gripper operating cam 30 retreats out of contact with the roller 28 on the jaw lever permitting the movable jaw 26, which is in initially open condition, to close against the edge of the sheet. At the same time the lip 41 of the front guide 40 "clears" the leading edge of the sheet as it moves to an upwardly retracted position thereby releasing the sheet, in registered condition, to the pre-gripper, which then swings the sheet from the pick-up position to the sheet releasing position at the surface of the impression cylinder. The cam face 31 and the control cam 52 are contoured so that, as the jaw 26 arrives at the releasing position, the cam 30 catches up with the roller 28, so that the jaw 26 opens for transfer of the sheet to the grippers on the impression cylinder. The grippers on the impression cylinder, and the means for synchronously operating them, being entirely conventional, are not illustrated.

After transfer to the impression cylinder has taken place, the swinging movement of the pre-gripper reverses. At the same time the control cam follower 52, riding high on the cam 50, restores the gripper operating cam 30 and front stop 40 to their illustrated positions in which the gripper operating cam serves to hold the jaw 26 open on its return trip while the front stop 40 is interposed in its obstructing position to intercept, and register, the next sheet fed across the feed table.

By the use of a single control cam and cam follower and a single linkage for operating both the gripper cam and the front stop, highly accurate synchronization between them can be achieved, from the lowest to the highest operating speeds. Use of the single linkage means that any play which may develop over passage of time due to wear or the like affects both functions to substantially equal degree and does not, therefore, affect the accuracy of synchronization. The synchronization may be initially adjusted by the simple expedient of turning the nut 68 so as to produce sufficient lost motion at 72 to delay retraction of the front stop until the moment of gripping, and such adjustment, once made, remains fixed so that the device will operate satisfactorily for long periods of time without maintenance or readjustment.

When it is desired to silence the feeding of the sheets to the impression cylinder, the switch 87 is actuated to energize the solenoid, rotating the pawl lever clockwise into its obstructing position. This prevents the control cam follower 52 from dropping into the "low" of the cam 50, preventing movement of the linkage and holding the gripper cam 30 in a position to maintain the jaw 26 open, particularly in the position of pick-up, so that it does not grip the sheet. Defeating motion of the linkage also insures that the front stop 40 will remain in its obstructing position, preventing release of a sheet from the table. Thus perfect synchronization between jaw and front stop is achieved during operation and dual disabling of jaw and front stop is achieved during silencing: this is to be contrasted with prior jaw and stop mechanisms in which the jaw and stop are actuated through different or independent linkages.

While the invention has been described in connection with a single jaw 26 and single stop 40, it will be understood that jaws 26 may be provided in multiple spaced along the width of the sheet and that additional front stop members 40 may also be provided in multiple spaced along the shaft 42 in interposed positions.

Not only does the present mechanism provide more precise synchronization, particularly at high speeds, and more effective silencing but it possesses a number of other advantages as well, including a high degree of compactness, use on presses from the largest to the smallest in the line, freedom for inertial problems and a high degree of economy in construction and operation.

What is claimed is:

1. In a feed assembly for feeding sheets seriatim from a position of register to grippers on an impression cylinder in a printing press, the combination comprising a press drive, a feed table presenting its front edge to the impression cylinder, a front stop at the front edge of the feed table having positioning means for moving the front stop between an interposed position in which it registeringly intercepts the front edge of a sheet and a retracted position in which it frees the sheet for transfer from the table, a pre-gripper assembly having a frame mounted for swinging movement and a gripper pivoted thereon, the gripper having a movable jaw and a jaw lever in the form of a cam follower for operating the jaw, the pre-gripper frame having an oscillating connection with the press drive so that the jaw is periodically swung from a sheet pick-up position at the front edge of the table to a sheet-releasing position at the surface of the impression cylinder, a gripper operating cam arranged in the path of movement of the jaw lever and mounted for retreating and return movement with respect thereto, a rotary control cam coupled to the press drive and having a control cam follower, linkage connecting the control cam follower to the gripper operating cam for controlling the retreating and return movement of the gripper operating cam so that the jaw is open and subsequently closed upon the edge of the awaiting sheet upon reaching the pick-up position, and means including a phasing connection for drivingly coupling the linkage to the front stop positioning means with such phasing that the front stop is moved to a retracted position to free the sheet timed with closure of the jaw upon the sheet.

2. The combination as claimed in claim 1 in which the phasing connection is in the form of a lost motion connection between the linkage and the front stop with means for varying the amount of lost motion thereby to vary the phasing of the retraction of the front stop with respect to the closure of the movable jaw on the sheet.

3. The combination as claimed in claim 1 in which means are provided for disengaging the control cam follower from the rotary control cam to prevent both closure of the jaw and retraction of the front stop thereby to interrupt feeding of sheets from the table.

4. The combination as claimed in claim 3 in which biasing means is provided including a spring for biasing the control cam follower into engagement with the control cam and in which the disengaging means is in the form of a pawl which is effectively interposed in the path of following movement of the control cam follower, the pawl being connected to an electromagnet for moving the pawl into its interposed position.

* * * * *